United States Patent [19]

Bijttebier et al.

[11] Patent Number: 4,572,499

[45] Date of Patent: Feb. 25, 1986

[54] PROCESS AND APPARATUS FOR REGISTERING SHEETS

[75] Inventors: Gaspar A. H. Bijttebier, Grote Heerweg 64, B- 8749 Waregem (Beveren Leie); Jozef Vangheluwe, Roeselare, both of Belgium

[73] Assignee: Gaspar A. H. Bijttebier, Waregem-Beveren, Belgium

[21] Appl. No.: 615,041

[22] Filed: May 29, 1984

[51] Int. Cl.[4] ..... B65H 9/16

[52] U.S. Cl. ..... 271/251; 271/195; 271/197; 271/254; 271/276

[58] Field of Search ..... 271/251, 197, 243, 250, 271/253–255, 276, 195, 196

[56] References Cited

U.S. PATENT DOCUMENTS 3,709,596 1/1973 Ulmer ..... 271/251 X 4,147,339 4/1979 Shiina ..... 271/251 X 4,440,389 4/1984 Ames ..... 271/251

FOREIGN PATENT DOCUMENTS 267420 8/1964 Netherlands ..... 271/251

*Primary Examiner*—Richard A. Schacher

*Attorney, Agent, or Firm*—Shlesinger Arkwright Garvey & Fado

[57] ABSTRACT

A process and apparatus for registering flexible sheets has a first conveyor belt with a smooth sheet contacting surface movably mounted to a frame. A movable abutment belt is mounted to said frame and juxtaposed with said conveyor belt. The conveyor belt and the abutment belt move at the same rate of speed so that a sheet deposited on said conveyor belt is engaged by and aligned with said abutment belt and is thereby registered during advancement between said inlet end and said outlet end.

20 Claims, 3 Drawing Figures

PROCESS AND APPARATUS FOR REGISTERING SHEETS

The present invention relates to a method and apparatus for registering, that is, accurately aligning and positioning flexible textile sheets, reregistering flexible sheets, particularly textile sheets. The textile sheets are in the process of being delivered from upstream processing units, such as cutting machines, to downstream processing units, such as sewing machines. The apparatus and method may be advantageously utilized in the sewing industry, particularly in the ready-made clothing industry.

BACKGROUND OF THE INVENTION

A garment, whether a shirt, a skirt, a pair of pants or the like is, comprised of a plurality of individual textile segments which are sewn together, or otherwise joined, in order to provide the garment. The segments are not only individually shaped but also have a number of sizes corresponding to the number of sizes in which the garment is supplied. It can be appreciated, therefore, that the manufacture of a single garment is a rather complicated undertaking.

Clothing manufactured by the ready-made clothing industry must be relatively inexpensive. Conventional practice in this industry has been to layer a plurality of individual textile sheets into a stack. The sheets are usually of various colors and the entire stack is cut or punched in a single operation so that all of the sheets of the stack are of the same size and style. Each of the cut sheets therefore forms a segment of a garment. It can be appreciated, therefore, that each segment of each garment is cut or punched in a similar operation with the result that a large number of stacks of garment sections must be provided prior to the preparation of even a single garment.

Manufacture of a single garment requires the sewing together of the segments. Each of the segments is individually removed from its associated stack. The segments are thus separated one after another from the associated stack and they are delivered to the appropriate processing units, in particular the sewing machines. The delivery process requires much hand manipulation due to the need to assure that only a single segment is removed from each of the stacks. One skilled in the art can appreciate that the variously layered segments are frequently stuck together at their edges. This tendency to stick together has been a major problem and was only recently resolved by the separating mechanisms and processes invented by the present applicants and accorded U.S. Pat. Nos. 3,981,495 and 4,437,655. Once the segments have been separated from their stacks, then they must be registered so as to be in the exact position ready for processing.

Bijttebier, U.S. Pat. No. 3,438,018, discloses a system for registering textile sheets. That patent, however, discloses a vibration system for registering the sheets. The vibration system is, however, frequently too slow in operation to be useful with automated sewing machines and the like.

Consequently, one skilled in the art can appreciate that a relatively high speed system for transporting and registering textile segments would be advantageous in facilitating the automation of the ready-made clothing industry. The disclosed invention provides such a registering apparatus and method and provides a conveyor having a smooth upper surface adapted for conveying a garment segment from a first processing unit to a second processing unit. A movable abutment means is angularly disposed relative to the longitudinal direction of the conveyor and is adapted for engaging one edge of the garment segment and for thereby positioning the segment so as to be in the appropriate position upon arrival at the second processing unit. A drive system for the conveyor and the abutment means is provided so that the conveyor and the abutment means move at the same velocity. This means that the velocity component of the abutment means in the direction of movement of the conveyor means is essentially equal to the velocity of this conveyor means. Additionally, another conveyor is superposed on the abutment means in order to maintain the segments in the flattened condition and prevent the edge thereof from becoming curled.

OBJECTS OF SUMMARY OF THE INVENTION

A primary object of the disclosed invention is to provide a method and apparatus for registering textile sheets which is continuous and simple to operate at high speed.

Yet another object of the disclosed invention is to provide a speed control system assuring that the main conveyor and the abutment means move at the same rate of speed.

Yet a further object of the disclosed invention is to provide an abutment means forming an angle of less than 30° with the direction of movement of the main conveyor belt.

Still a further object of the disclosed invention is to provide a suction system for maintaining the sheets on the primary conveyor belt.

According to the invention, the sheets or segments are deposited one after the other on a first conveyor. The conveyor has a smooth upper surface in order to allow easy sliding of the segments. The sheets are advanced progressively with at least one of their edges engaging a movable abutment during moving with the conveyor. The abutment means runs at the same velocity as the conveyor and is in contact with the smooth upper surface thereof. Means are provided for flattening the sheets against the conveyor during their movement in order to prevent curling of the edges.

These and other objects and advantages of the invention are readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawngs, wherein.

DESCRIPTION OF THE INVENTION

Figure 1:
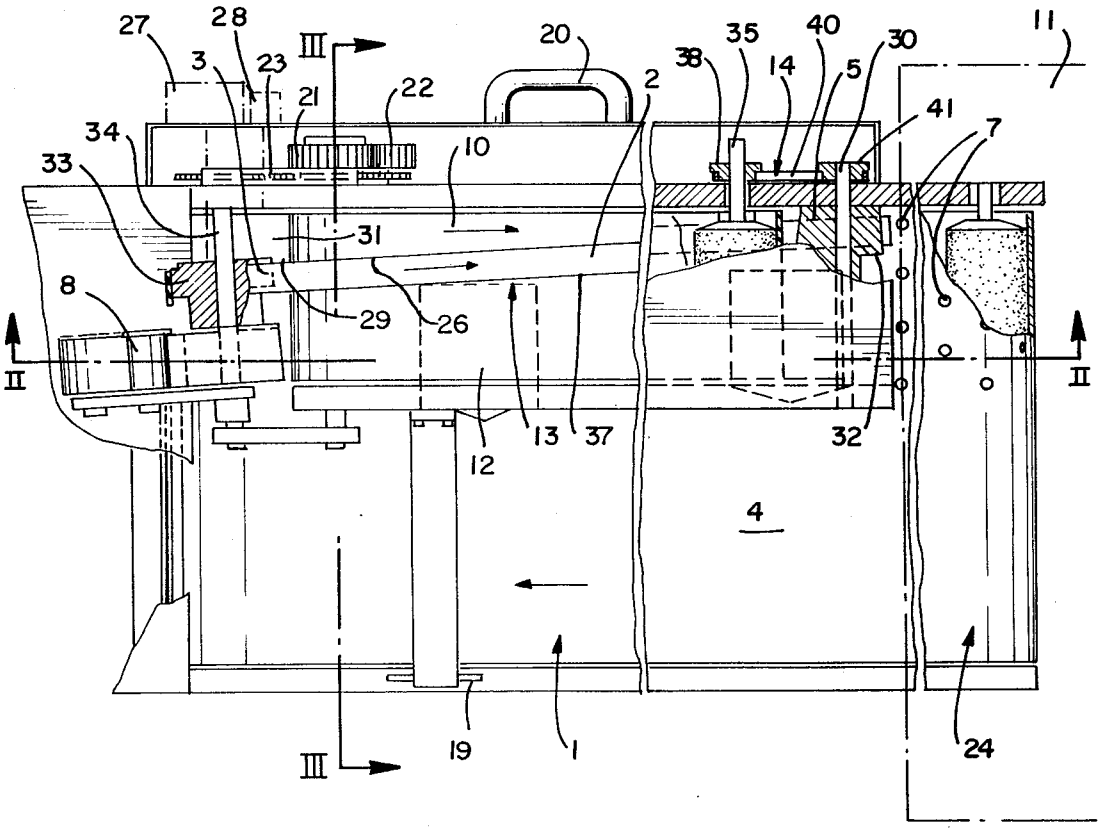
FIG. 1 is a top plan view with portions broken away of the registering device of the invention.
Figure 3:
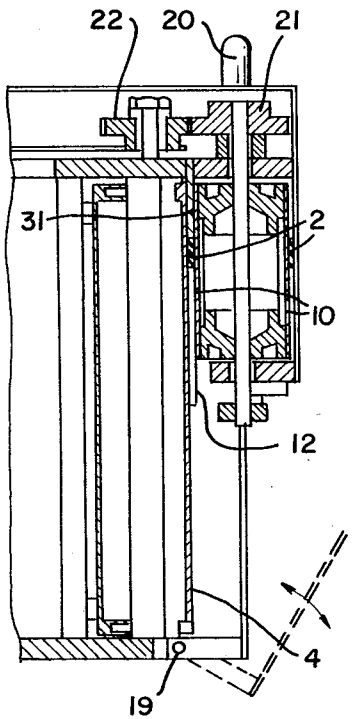
Figure 2:
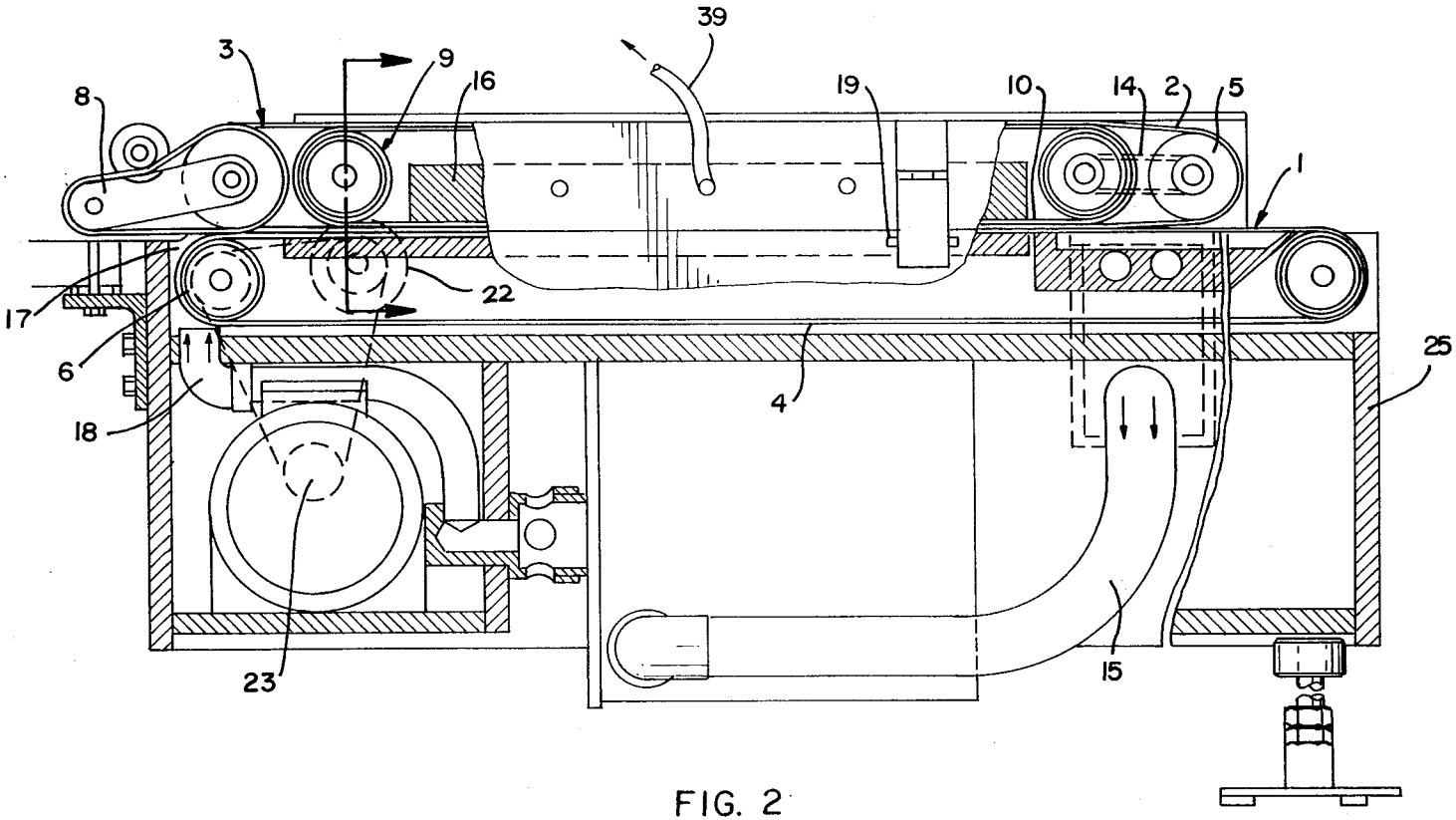
FIG. 2 is a cross sectional view with portions broken away taken along the section 2—2 of FIG. 1 and viewed in the direction of the arrows; and, FIG. 3 is a cross sectional view taken along the section 3—3 of FIG. 1 and with phantom lines indicating pivoting thereof.

The apparatus, as best shown in FIGS. 1–3, includes a ground supported frame 25. Conveyor means 1 are mounted to frame 25 and flexible sheets 12 are deposited one after the other at a first end 24 of frame 25. The sheets 12 are, generally, delivered by a device 11 which can be a sheet separating and transporting unit, as described in U.S. Pat. No. 4,348,018.

The conveyor means 1 comprises an endless belt 4 having a smooth outer surface. Speed rollers 6 are rotatably mounted to frame 25 and are adapted for driving belt 4. The rollers 6 and the belt 4 are adapted for transporting the sheets 12 from device 11 to feed-in mechanism 8 of a second mechanism 8 of a second processing unit, (not shown). The belt 4, preferably, is a single belt but those skilled in the art can appreciate that a number of adjacent closely spaced belts may perform the same function.

The registering operation essentially relates to the cooperation of the running belt 4 and the abutment means 3 which moves in contact with the smooth surface of belt 4 and at the same speed or velocity as the belt 4. The abutment means 3 includes, preferably, a conveyor belt or abutment belt 2 driven by drive pulley 5. Preferably, the conveyor belt 2 has a width approximately 20% of the width of belt 4 to save space and to prevent kinking of the belt 2.

The abutment means 3 is arranged with a controllable orientation so that its direction of movement forms an angle of less than 30°, and preferably less than 15°, with the direction of movement of belt 4, for example, an angle of 5°. An actuator 27 is mounted to frame 25 and is adapted for angularly displacing the abutment means 3 relative to the longitudinal direction of movement of the belt 4. The actuator 27 may include an hydraulic cylinder and piston assembly, an electric motor driven worm gear, or other displacement means which are well known to those skilled in the art. The actuator 27 is adapted to adjust the direction or positioning of the abutment means 3 so that the movement of belt 2 provides a suitable transverse velocity or displacement component for sheet 12 with respect to the moving direction of conveyor means 1.

A rotatable shaft 30 is mounted to frame 25 at generally end 24. Drive pulley 5 is mounted to shaft 30 and conveyor belt 2 is rotated by pulley 5.

Pulley 5 has a convex surface 32 which is contoured and radius chosen so that the running velocity of the belts 2 and 4 will be the same. This means that the velocity compartment of belt 2 in the direction of the movement of belt 4 is essentially equal to the speed of belt 4. Pulley 5 is driven by a drive transmission 14, as will be explained herein later. A second shaft 34 is rotatably mounted to frame 25, and spaced from and angularly disposed relative to shaft 30. Shaft 34 is, preferably, adjacent feed-in mechanism 8. Pulley 33 is mounted to shaft 34 and engages belt 2 in order to facilitate the advancement or rotation of belt 2. Actuator 27 is engageable with pulley 33 and is adapted for shifting or displacing pulley 33 transverse of the direction of movement of the belt 4. Shaft 34 is angularly disposed to approximate an arc for belt 2 pivoting on pulley 5.

The transverse shifting of pulley 33 on shaft 34 permits the angle with belt 4 to be adjusted to thereby permit orientation of sheets 12 in any number of selected positions. Actuator 27 is engageable with pulley 33 and is adapted for shifting pulley 33 to thereby effectuate displacement of the belt 2. The convex surface 32 of pulley 5 is uniquely adapted for confirming to the angular positioning of the belt 2 with the effect that the belt 2 pivots on the convex surface 32 as the pulley 33 is laterally shifted. The convex surface 32, therefore assures the continuous training of the belt 2 on its pulleys 5 and 33 while also assuring that belt 2 maintains proper velocity conformation with belt 4. Surface 32 serves to prevent kinking of the belt 12 as it is angularly repositioned.

An alignment plate 31 is disposed above belt 4, as best shown in FIG. 3, and adjacent belt 2. Plate 31 has an oblique side edge 29 which is adapted for engagement with side edge 26 of belt 2. The oblique edge 29 serves to ensure that the belt 2 runs in a well defined path and thereby serves to maintain the belt 2 in its proper orientation. An adjustment means 28 is mounted to frame 25 and is engageable with oblique plate 31. The adjustment means 28 cooperates with the actuator 27 so that shifting of pulley 36 causes associated shifting of alignment plate 31. The cooperation of the actuator 27 and means 28 serves to assure that the belt 2 will always be in its proper orientation. Consequently, shifting of the pulley 2 and the alignment plate 31 facilitates the proper registering of the sheets 12 and also permits accommodation when different sheets 12 are utilized. Consequently, the actuator 25 and means 28 permit the abutment means 3 to be utilized regardless of which of the many sheets or segments 12 is being transported by the belt 4.

The apparatus further includes flattening means 9 cooperating with the conveyor means 1 and the abutment means 3. The flattening means 9 consists of a driven conveyor belt or flattening belt 10 having a smooth outer surface. Belt 10 runs with its underside in the same direction as the upper side of belt 4 and at the same speed. A shaft 35 is rotatably mounted to frame 25 and is adapted for driving belt 10. The belt 10 is disposed above belt 4 and is adapted for bearing against the sheets 12, particularly the contact edge 13 thereof, and for maintaining the sheets 12 in the proper alignment. The belt 10 thereby prevents curling of the sheets 12.

The sheets 12, which are transported by the belt 4, are progressively advanced and have an edge 13 thereof engaging the side edge 37 of belt 2. The edge 13 is aligned with the side edge 37 of belt 2 at a desired angle of less than 30° with the direction of movement of the belt 4. The presence of the flattening belt 10 prevents the edges 13 from curling up against or under the edge 37 of the belt 2.

The belt 4, preferably, includes a plurality of holes or apertures 7 therethrough. An aspirator 15 is then connected to the frame 25 at the entrance section 24 of the sheets 12 between the belts 4 and 10 and is adapted for aspirating air through the holes 7 in order to urge the sheets 12 into contact with the belt 4. The aspirating effect of the aspirator 15 is sufficient, particularly in combination with the flattening belt 10, to maintain the sheets 12 in engagement with the belt 4 in a flat condition.

Guiding block 16 is disposed above flattening belt 10 and is adapted for engaging the flattening belt 10 when the belt 10 is lifted by aspiration of air through hose 39. The lifting of the belt 10 prevents the flattening belt 10 from hampering the sliding of the sheets 12 on belt 4 against the edge 37 of the belt 2. A suitable distance between the upper surface of the sheets 12 and the underside of the flattening belt 10 is at least 1 mm and, preferably, not more than 5 mm. A slight blowing action may be exerted at the take-over slip 17 by means of blower fan 18 in order to ensure a smooth take-over of the sheets 12 by the feed-in device 8 at the outlet end of the registering apparatus.

The assembly of flattening device 9, abutment device 3 and feed-in device 8 can be mounted in one frame which is then pivotally fixed to the frame 25 of conveyor 1 in pivots 19. The assembly can be lifted by handle 20. Lowering the frame causes gear 21 to engage driving gear 22. Driving gear 22 is coupled to driving motor pulley 23. It can be appreciated, therefore, that driving motor pulley 23 drives belt 4 and gear 22. Gear 22, which is engageable with gear 21, drives belt 10 and thereby also chain transmission 14 because of pulley 38 mounted to shaft 35 and chain 40 extending therebetween. Consequently, rotation or movement of the belt 10 causes a corresponding rotation of the belt 2 because of the chain transmission 14 stretching between pulley 38 of shaft 35 and pulley 41 of shaft 30.

It is possible to move the abutment means 3 back and forth in a direction transverse to the advancement direction of the conveyor means 1 because of the actuator 27 and adjustment means 28. The apparatus also permits a cessation in the advancement of the sheets 12 for a time interval even while the conveyor means 1 continues to move. This permits segments 12 to be placed in a holding pattern in the event of a malfunction downstream by the secondary processing units. The sheets 12 can be stopped by urging them against the smooth surface of the conveyor 4 by an appropriate action of the flattening belt 10. The smooth outer surface of the belt 4 facilitates this cessation of movement.

In some cases, the sheets 12 are secondarily treated after initial registering by a processing unit while sliding on the smooth surface of the conveyor means 1. The sheets 12 can be reregistered after a first processing and may be reprocessed by other processing units a number of times while they are on the smooth surface of the conveyor means 1. Preferably, the belts 4, 2 and 10 have a speed ranging from 5 to 30 meters per minute. The belt speed be e.g. maintained at approximately 15 meters per minute when the processing unit downstream is a seam sewing machine.

In another embodiment, the conveyor means 1 may be arranged to move back and forth cyclically between the place of deposition of the sheets 12 at the end 24 and the processing units. Preferably, this is in synchronization with the processing cycles of the various processing units.

The invention is not limited to the embodiment described above as it may be desirable, at least in some case, to replace the conveyor belts 4, 2 and 10 with a system using transportation plates having a smooth surface. The sheets 12 are then deposited one after the other onto the transportation plates which move back and forth between a position of receipt of the sheets 12 and a position of delivery of the sheets 12 to a feed-in device 8 for a processing unit. After deposition of the sheets 12 on the transportation plate 12, a flattening plate is brought over the transportation plate and moved with it to the delivery station. At the same time, abutment means, in the form of a lath suitably interposed between the transportation plates and the flattening plate and coupled to the transportation plate, moves in direction transverse to the transportation plate. This transverse movement forces the sheet 12 to slide on the transportation plate so as to align itself with at least one edge 13 against the abutment lath and so to register the sheet 12 during its transportation in the desired position for delivery to the processing unit.

Although this invention has been described as having a preferred design, it is understood that it is capable of further modifications, uses and/or adaptations of the invention following in general the principles of the invention and including such departures from the present disclosure as come within known or customary practice in the art to which the invention pertains, as may be applied to the central features hereinbefore set forth, and fall within the scope of the invention of the limits of the appended claims.

What is claimed is:

1. An apparatus for registering flexible sheets, comprising:

(a) a ground supported frame;

(b) conveyor means having a smooth sheet contacting surface movably mounted to said frame and extending between an inlet end and an outlet end of said frame;

(c) movable abutment means mounted to said frame juxtaposed to said sheet contacting surface;

(d) drive means mounted to said frame and adapted for moving said conveyor means and said abutment means at subtantially equal speed whereby a flexible sheet deposited on said sheet contacting surface at generally said inlet end is engaged by and aligned with said abutment means during advancement between said inlet and said outlet ends and is thereby registered and (e) flattening means mounted to said frame juxtaposed to said abutment means for maintaining said sheet flat during engagement with said abutment means.

2. The apparatus defined in claim 1, further comprising adjustment means mounted to said frame and engageable with said abutment means for shifting said abutment means relative to said conveyor means.

3. The apparatus defined in claim 2, wherein said abutment means are disposed at an angle of less than 30° with respect to the direction of movement of said conveyor means.

4. The apparatus as defined in claim 3, wherein:

(a) guiding block is disposed above said flattening belt; and, (b) means for lifting said flattening belt against said guiding block are disposed for preventing hampering of advancement of the sheet.

5. The apparatus as defined in claim 4, wherein said flattening belt is disposed between approximately 1 millimeter and 5 millimeters above the sheet.

6. The apparatus defined in claim 2, wherein said abutment means are disposed at an angle of less than 15° with respect to the direction of movement of said conveyor means.

7. The apparatus defined in claim 2, wherein said abutment means includes an endless abutment conveyor belt.

8. The apparatus defined in claim 7, wherein :

(a) first and second spaced shafts are rotatably mounted to said frame, one of said shafts is mounted generally adjacent said inlet end and the other of said shafts is mounted generally adjacent said outlet end;

(b) a first pulley having a convex belt engaging surface is mounted to said first shaft and is rotatable therewith;

(c) a second pulley is mounted to said second shaft and is rotatable therewith; and (d) said abutment belt is disposed between and engaged with said first and second pulleys and is adapted for movement upon rotation of said shafts.

9. The apparatus defined in claim 1, wherein said conveyor means includes at least a first endless conveyor belt.

10. The apparatus defined in claim 9, further comprising blowing means are secured to said frame at generally said outlet end for lifting said sheet a slight distance at said outlet end for facilitating take over of said sheet by the feed-in device for the processing unit.

11. The apparatus defined in claim 9, wherein:

(a) a plurality of apertures are disposed in said first conveyor belt; and (b) an aspiration system is mounted to said frame below said first conveyor belt at generally said inlet end and is adapted for aspirating air through said apertures for maintaining said sheet against said sheet contacting surface.

12. The apparatus defined in claim 1, wherein:

(a) said flattening means includes a movable endless flattening conveyor belt disposed above said abutment means.

(b) said flattening means has a smooth surface adjacent said conveyor means sheet contacting surface; and (c) belt drive means cooperate with drive means and are adapted for moving said endless flattening conveyor belt at a speed substantially equal to said conveyor means and said abutment means speed.

13. The apparatus defined in claim 1, wherein:

(a) a guiding block is disposed above said flattening means; and (b) means for lifting said flattening means against said guiding block are disposed for preventing hampering of advancement of said sheet.

14. The apparatus defined in claim 13, wherein said flattening means are disposed between approximately 1 mm and 5 mm above said sheet.

15. An apparatus for registering flexible sheets, comprising:

(a) a ground supported frame having an inlet and an outlet end;

(b) a conveyor belt having a smooth sheet contacting surface movably mounted to said frame and extending between said inlet and said outlet end of said frame;

(c) a movable abutment belt associated with said frame having an edge portion adapted for abutting the flexible sheets, said belt being juxtaposed to said sheet contacting surface;

(d) drive means mounted to said frame and adapted for moving said conveyor belt and said abutment belt at substantially equal speed; and, (e) a flattening belt mounted to said frame juxtaposed to said abutment belt for maintaining said sheet flat during engagement with said abutment belt.

16. The apparatus as defined in claim 15, further comprising adjustment means mounted to said frame and engagable with said abutment belt for shifting said abutment belt relative to said conveyor belt.

17. The apparatus as defined in claim 16, wherein said abutment belt is disposed at an angle of less than 30° with respect to the direction of movement of said conveyor belt.

18. The apparatus as defined in claim 17, wherein said abutment belt is disposed at an angle of less than 15° with respect to the direction of the movement of said conveyor belt.

19. The apparatus as defined in claim 15, further comprising blowing means, secured to said frame at generally said outlet end, for lifting said sheet a slight distance at said outlet end and for facilitating take over of said sheet by a feed-in device for a processing unit.

20. The apparatus as defined in claim 15, wherein:

(a) a plurality of apertures are disposed in said first conveyor belt; and, (b) an aspiration system is mounted to said frame below said first conveyor belt at generally said inlet end and is adapted for aspirating air through said apertures for maintaining said sheet against said sheet contacting surface.

* * * * *